US006250694B1

(12) United States Patent
Weiland

(10) Patent No.: US 6,250,694 B1
(45) Date of Patent: Jun. 26, 2001

(54) PUSH-PUSH LATCH

(75) Inventor: Nicholas Roy Weiland, Worcester (GB)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 09/388,579

(22) Filed: Sep. 2, 1999

(51) Int. Cl.[7] ..... E05C 19/10

(52) U.S. Cl. ..... 292/110; 292/121; 292/122; 292/DIG. 4

(58) Field of Search ..... 292/110, 114, 292/122, 128, 99, 101, 102, 220, 228, 202, 203

(56) References Cited

U.S. PATENT DOCUMENTS 1,694,023 * 12/1928 Suck ..... 292/DIG. 4 X
2,294,683 * 9/1942 Murphy ..... 292/DIG. 4 X
4,383,707 * 5/1983 Nishimura ..... 292/110
4,655,489 4/1987 Bisbing .
5,518,282 * 5/1996 Sawada ..... 292/252

OTHER PUBLICATIONS

Southco, Inc. catalog No. 48 NA.

* cited by examiner

*Primary Examiner*—Teri Pham Luu
(74) *Attorney, Agent, or Firm*—Paul & Paul

(57) ABSTRACT

A latch wherein latching and unlatching is accomplished by an inward push by the keeper towards the latch uses an improved spring arrangement, allowing for quieter operation. A modified housing configuration works in conjunction with improved internal components to permit single direction assembly.

11 Claims, 11 Drawing Sheets

PUSH-PUSH LATCH

BACKGROUND OF THE INVENTION

1. Field of the Invention

The invention is a latch wherein latching and unlatching is accomplished by an inward push of a keeper towards the latch.

2. Description of the related art

Although other inventors have proposed push-push latches, the present inventor is unaware of any other latch having the simplicity, or the advantage in quietness and ease of assembly, as the present invention.

An example of a prior push-push latch is described in U.S. Pat. No. 4,655,489, issued to Robert H. Bisbing on Apr. 7, 1987. This latch hooks onto a corresponding keeper using a beam having a hook at one end. The movement of the beam is controlled by a shuttle, which is actuated by inward pressure applied by the keeper, and by a tension-compression spring. The compression portion of the spring biases the shuttle towards the frontal opening of the latch housing, and the tension end of the spring biases the front end of the beam rearward, causing the beam to rotate when acted on by the shuttle. This latch is also described in Southco, Inc., catalog, no. 48 NA. The present invention is an improvement over this latch, wherein the tension-compression spring is eliminated, and only a compression spring is used within the latch. Additionally, the present latch uses an improved housing and improved internal components, thereby reducing the number of parts and permitting single-direction assembly. The resulting latch has significantly quieter operation, fewer parts, and lends itself to automated assembly.

SUMMARY OF THE INVENTION

The present invention is a latch wherein latching and unlatching are controlled by an inward push by the keeper towards the latch, generally known as a push-push latch.

The latch includes a housing, containing a beam a shuttle below the beam, and a compression spring behind the shuttle, for biasing the shuttle for ward within said housing. The latch mates with a corresponding keeper to secure a moving member, such as a door or drawer, to a nonmoving member, such as the frame of the door or drawer. The latch will typically be secured to the moving member, with the keeper secured to the moving member, but the opposite arrangement will work equally well.

The housing is generally rectangular, and is preferably made of one-piece construction. The housing defines an opening in its front surface, and a pair of opposing openings in its side surfaces. A pair of opposing snap legs extends downward and inward into the housing from the front edges of the side openings. A second pair of opposing snap legs extends upward and outward from the rear portion of the housing's top and bottom sides, ending with a ridged surface. It should be noted that top and bottom are used herein for simplicity of reference only and the housing could be rotated to define a different top surface without changing the functioning of the latch.

The beam is located within the housing, extending from the front opening towards the rear of the housing. The beam may be located adjacent to either the top or bottom of the housing without altering the manner of operation, and for simplicity of reference, the following discussion assumes that the beam is adjacent to the housing's top. The front end of the beam includes a hook for engaging the keeper, described below. The hook includes a flange extending to one side. The rear end of the beam includes a pivot, which is preferably a pair of bosses extending between the inner snap legs and the rear of the side openings. The motion of the beam is thereby constrained to rotation around the axis of the bosses, and vertical translation within the housing. The rear of the beam also includes a rear downward projection, preferably having a hook shape, and a central, preferably triangular, downward projection extends from the center of the beam.

The shuttle is located below the hook. The rear of the shuttle defines a channel for guiding the compression spring, which abuts both the rear of the housing and the front of the channel. The front of the shuttle includes a front surface for making contact with the keeper (described later) and a top surface for supporting the beam's front hook. A flange extends upward to one side of the beam, immediately behind the flange extending from the beam's hook. An arm extends upward and rearward from the top of the shuttle, being dimensioned and configured to push against the rear downward projections of the beam.

The keeper includes a mounting plate, preferably having an adhesive backing, and a hook. The keeper's hook is dimensioned and configured to push inward on the shuttle's front surface, and to engage the beam's hook.

Assembly of the latch is accomplished by merely placing the spring, shuttle, and beam together so that they are positioned properly with respect to each other, and inserting the preassembled inner components into the housing. The inner snap legs engage the beam's bosses, securing the beam within the housing. The side flange of the beam's hook engages the shuttle's flange, thereby securing the shuttle within the housing. The spring is contained between the shuttle and housing. All components are thereby secured within the housing.

The latch will typically be installed within a socket. A preferred and suggested socket has the configuration of a pair of intersecting rectangles, corresponding with the shape of the housing, to prevent misalignment of the latch. Upon inserting the latch into the socket, the ridges on the outer snap legs will engage the edges of the socket, securing the latch within the socket. The keeper is then inserted into the latch, where it is secured therein as described below. The adhesive backing of the keeper is exposed, and the moving member to be secured by the latch is brought into its closed position, in contact with the adhesive. When the adhesive is dry, the keeper will be secured in the proper position to engage the latch.

The latching and unlatching cycle begins with the beam in its upward horizontal position, against the top of the housing, resting on the top surface of the shuttle. To actuate the latch, the moving member is moved into its closed position, thereby bringing the keeper and latch together, and inserting the keeper's hook into the latch. The keeper pushes the shuttle rearward, causing the shuttle's arm to push against the beam's rearward projection, rotating the beam's hook downward into engagement with the keeper's hook. The spring then pushes the shuttle forward, thereby pushing the keeper slightly outward The keeper pulls on the beam, thereby bringing the beam into a horizontal position. Continued forward motion of the shuttle is prevented by the shuttle's flange abutting the side flange of the beam's hook. The latch is now securely latched.

To unlatch the latch, the moving member is pushed inward, thereby causing the keeper to push the shuttle inward. The top surface of the shuttle pushes against the beam's central projection, rotating the beam upward and allowing the keeper's hook to exit the latch. The shuttle then moves fully forward. The shuttle's flange pushes on the side flange of the beam's hook, thereby moving the beam back into its original position.

It is therefore an object of the present invention to provide a latch wherein latching and unlatching is accomplished by an inward push by the keeper on the latch.

It is another object of the invention to provide a latch having quieter operation than other push-push latches.

A third object of the invention is to provide a latch that can be assembled entirely from one direction.

A fourth object of the invention is to provide a latch that may be assembled using automatic assembly techniques.

A fifth object of the invention is to provide a latch that is easy to install.

These and other objects of the invention will become apparent through the following description and claims.

BRIEF DESCRIPTION OF THE DRAWINGS

Like reference numbers denote like elements throughout the drawings.

DETAILED DESCRIPTION OF THE PREFERRED EMBODIMENTS

Figure 1:
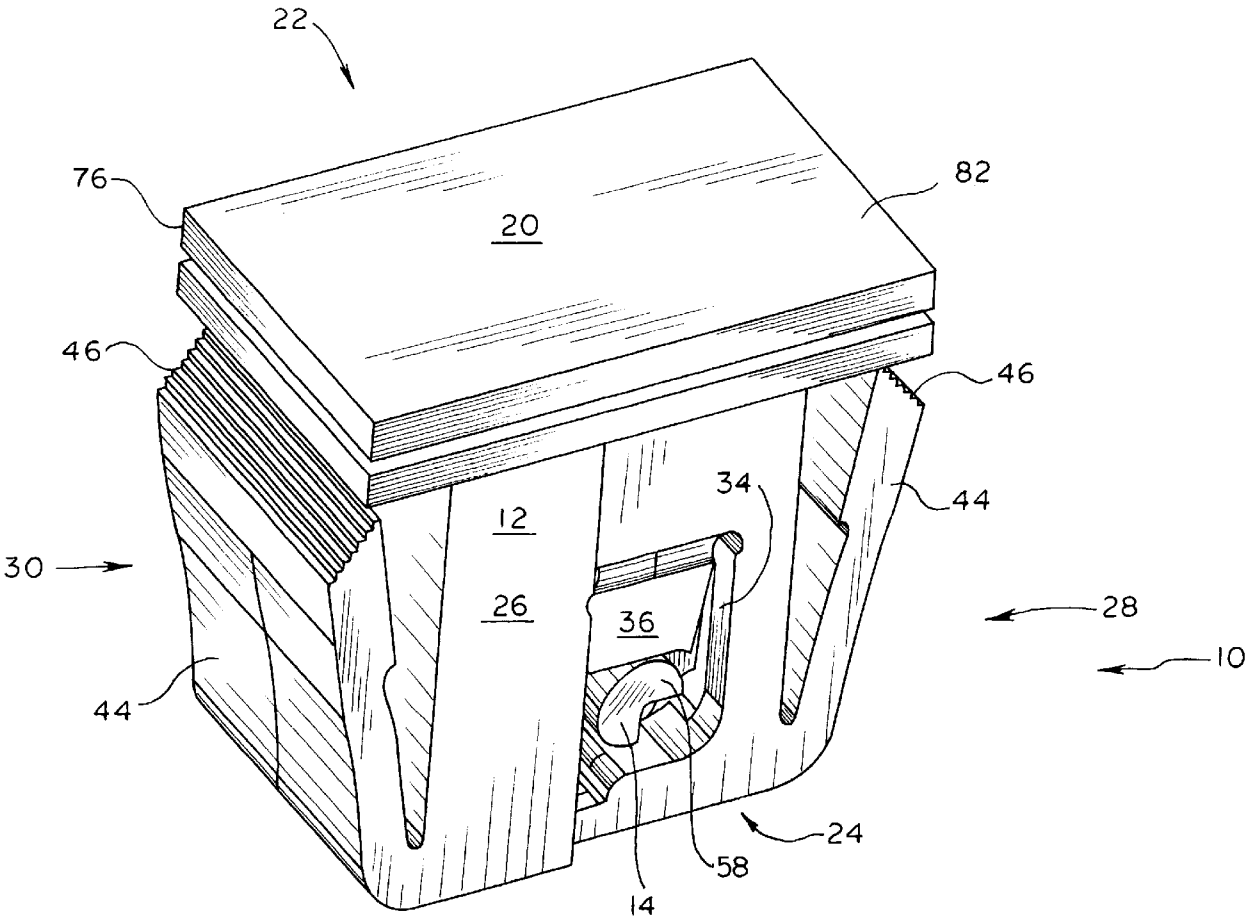
FIG. 1 is a perspective view of a latch assembly according to the present invention.
Figure 2:
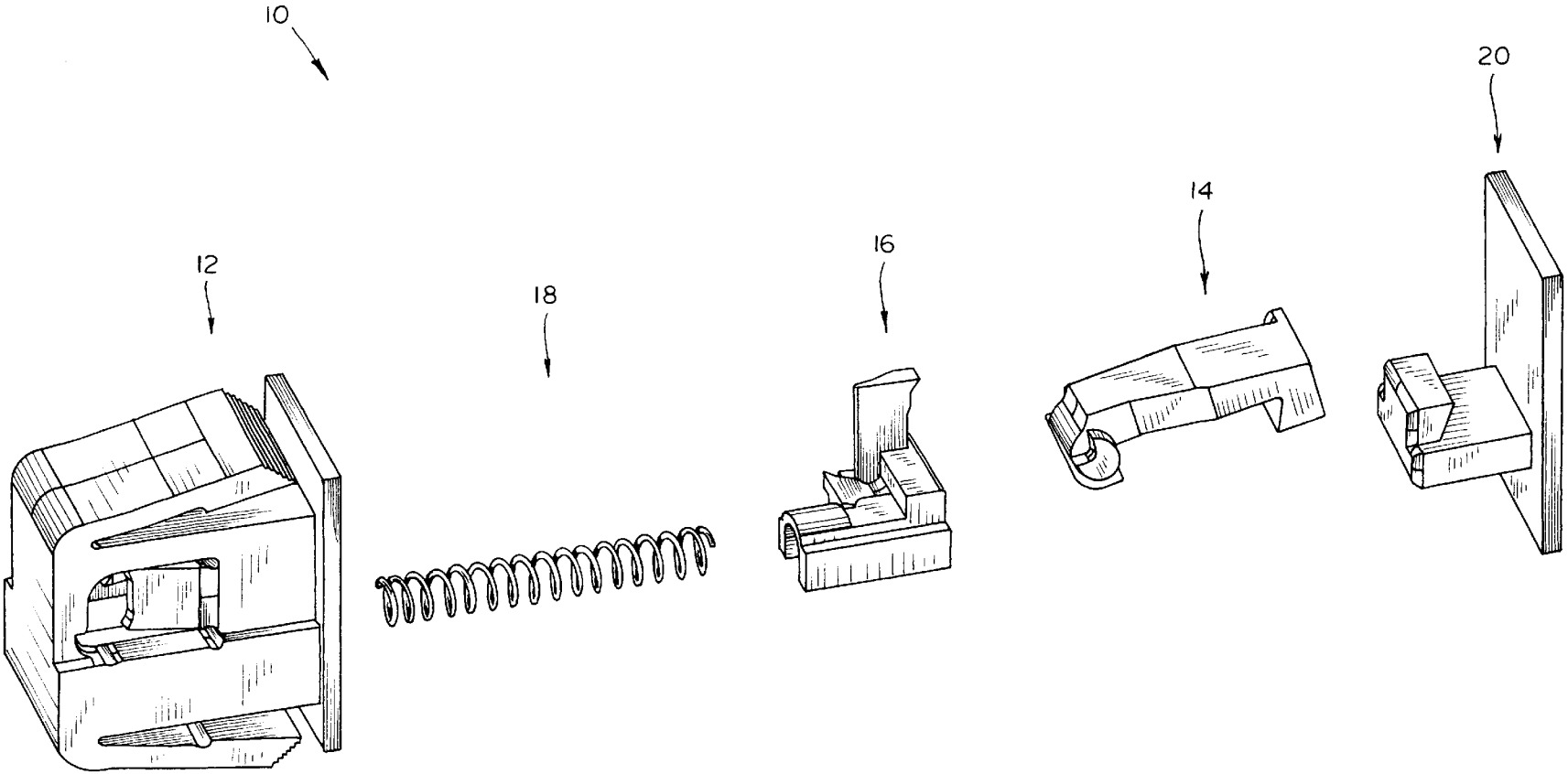
FIG. 2 is a top rear exploded perspective view of a latch assembly according to the present invention.
Figure 3:
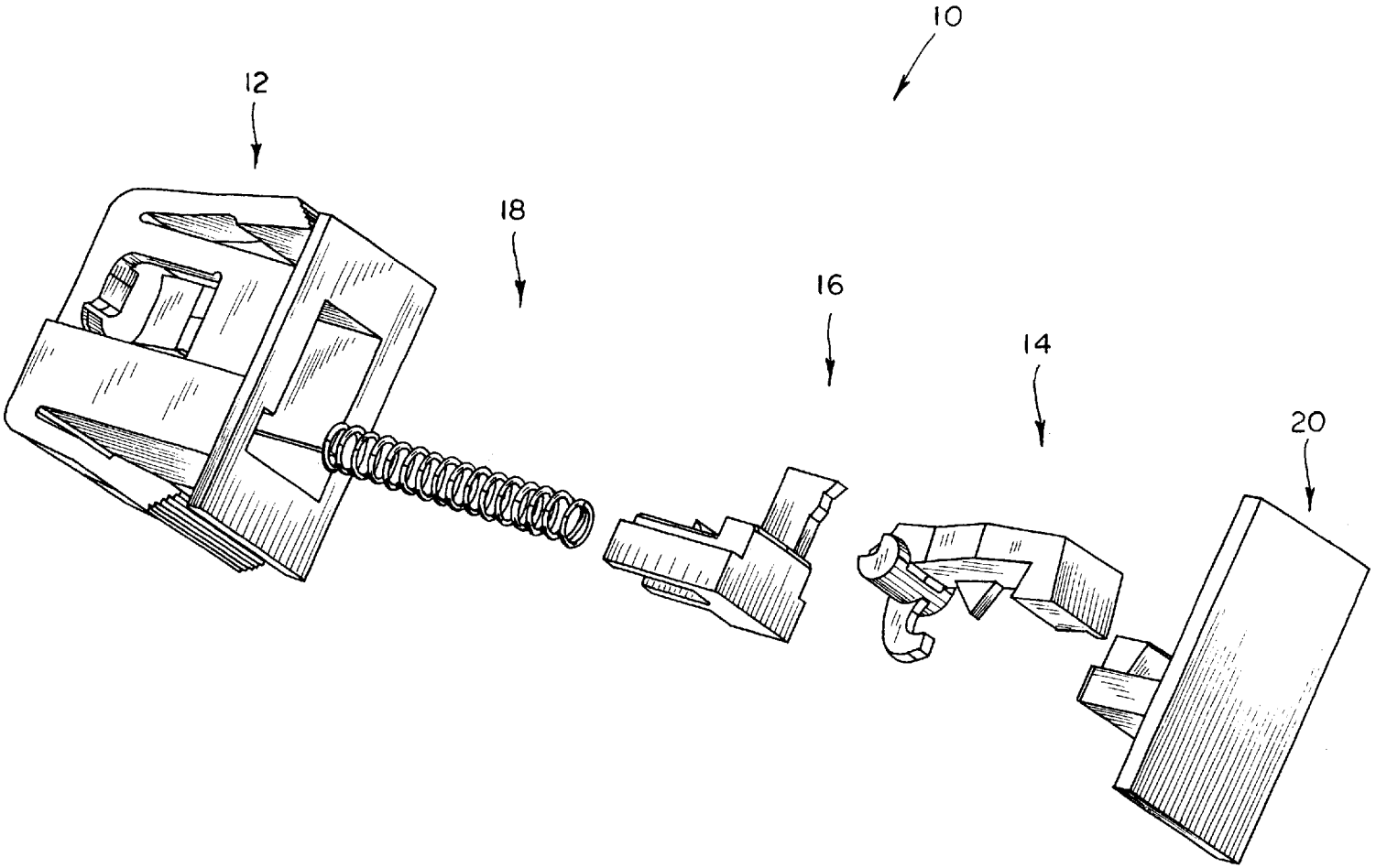
FIG. 3 is a bottom front exploded perspective view of a latch assembly according to the present invention.
Figure 4:
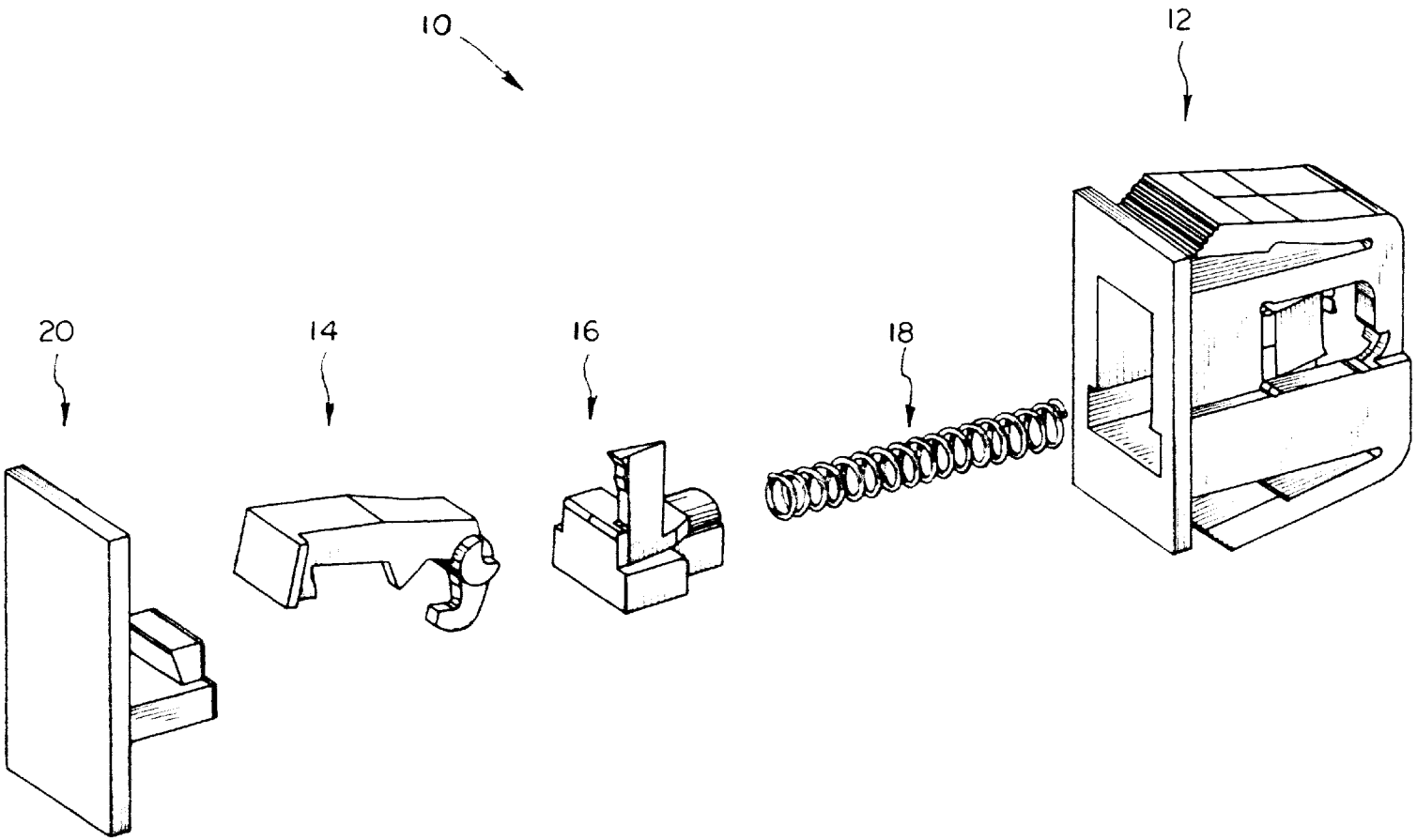
FIG. 4 is a top front exploded perspective view of a latch assembly according to the present invention.

The present invention is a latch wherein latching and unlatching are controlled by an inward push by the keeper towards the latch, generally known as a push-push latch. Please note that the following description refers to a top, etc. for simplicity of reference only, and not to imply that the orientation of the latch is critical to its function. Referring to FIGS. 1–4, the latch 10 includes a housing 12, a beam 14 within the housing 12, a shuttle 16 below the beam 14, and a spring 18 biasing the shuttle 16 forward. The latch mates with a corresponding keeper 20.

Figure 5:
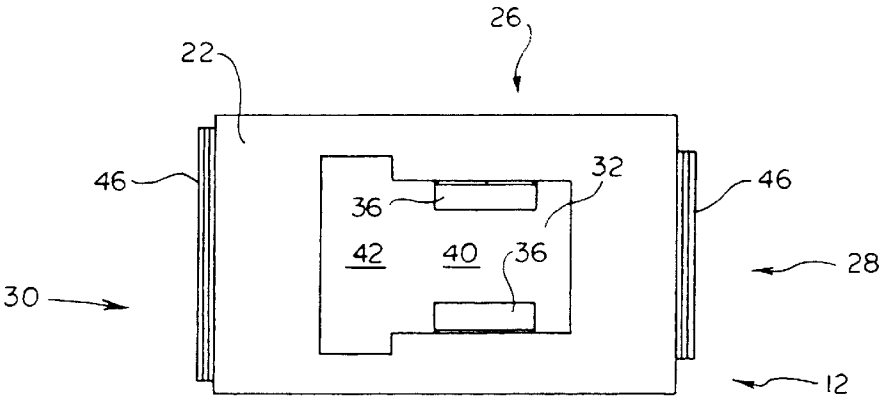
FIG. 5 is a front view of the housing for a latch assembly according to the present invention.
Figure 6:
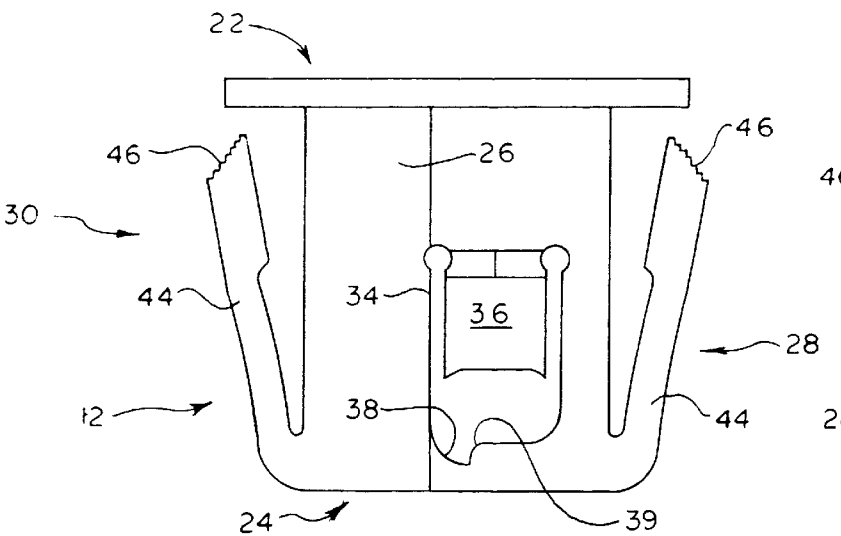
FIG. 6 is a side view of the housing for a latch assembly according to the present invention.
Figure 7:
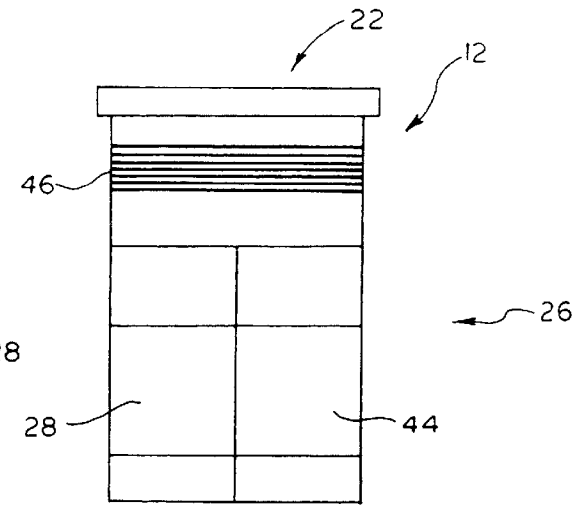
FIG. 7 is a top view of the housing for a latch assembly according to the present invention.

Referring to FIGS. 5–7, the housing 12 is illustrated. The housing 12 is of one-piece construction, having a front 22, back 24, two sides 26, a top 28, and a bottom 30. The front 22 defines an opening 32, having a narrow portion 40 corresponding to the top 28 of the housing 12, and a wide portion 42 corresponding to the bottom 30 of the housing 12. The sides 26 each define an opening 34. Each side opening 34 contains an inner snap leg 36, extending from the front edge of the opening 34 rearward and inward. The rear edges of side openings 34 include a notch 38, and an adjacent convex curved edge 39. The housing is preferably secured in a socket by a pair of snap legs. The top 28 and bottom 30 each include an outer snap leg 44, extending forward and outward from the back 24 of the housing 12. Each outer snap leg 44 has a ridged front end 46.

Figure 8:
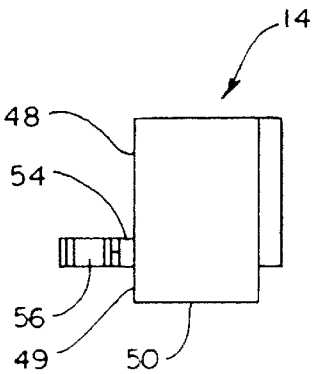
FIG. 8 is a front view of the beam for a latch assembly according to the present invention.
Figure 10:
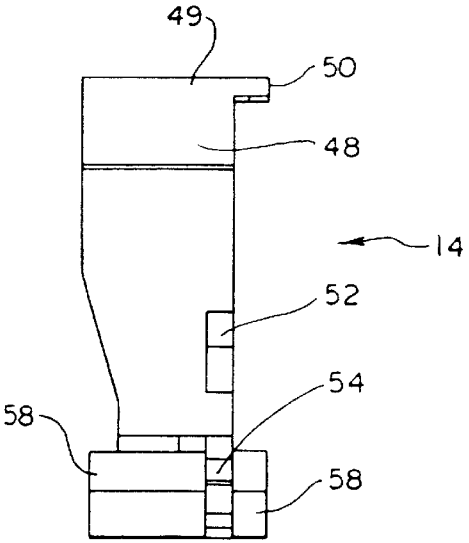
FIG. 10 is a bottom view of the beam for a latch assembly according to the present invention.
Figure 9:
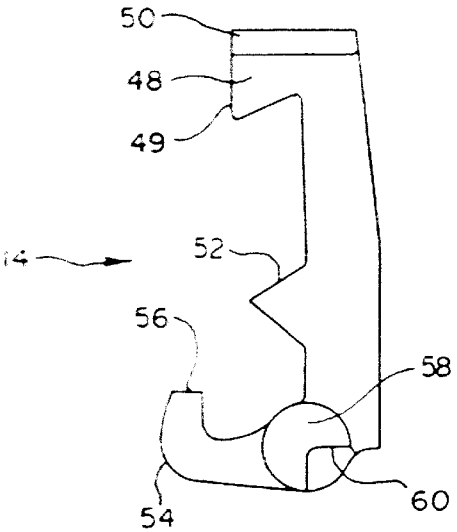
FIG 9 is a side view of the beam for a latch assembly according to the present invention.

Referring to FIGS. 8–10, the beam 14 is illustrated. The beam 14 includes a front hook 48, being dimensioned and configured to mate with the hook of the keeper 20 (described later). The bottom 49 of the hook is preferably a flat surface. A side flange 50 extends outward from the front hook 48. The middle section of the beam 14 includes a central downward projection 52, which is preferably triangular in configuration. The rear portion of the beam 14 includes a rear arm 54, which in the preferred embodiment is configured as a hook having a flat end 56. The rear portion of beam 14 also includes a pair of opposing bosses 58, being dimensioned and configured to fit within the side openings 34, behind and engaged by the inner snap legs 36. Each boss 58 defines a notch 60, being dimensioned and configured to correspond to the convex curved edge 39.

Figure 11:
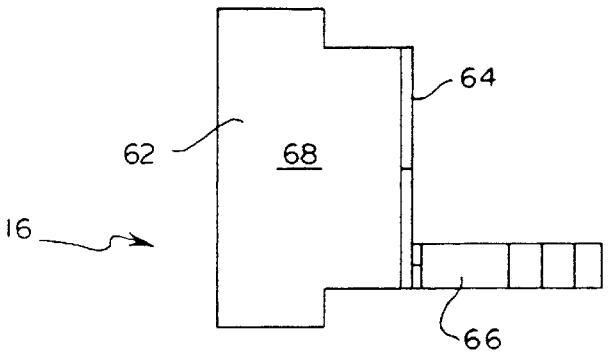
FIG. 11 is a front view of the shuttle for a latch assembly according to the present invention.
Figure 12:
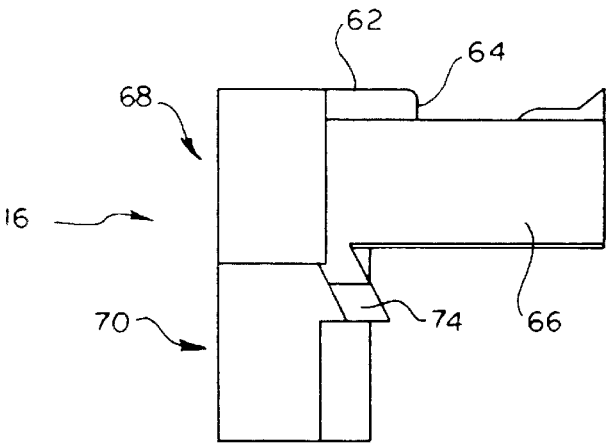
FIG. 12 is a side view of the shuttle for a latch assembly according to the present invention.
Figure 13:
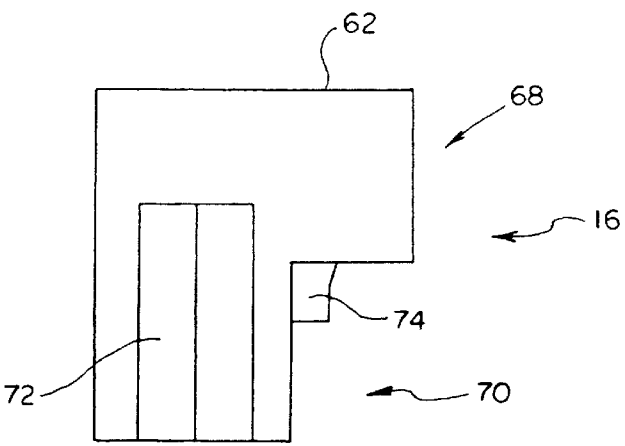
FIG. 13 is a bottom view of the shuttle for a latch assembly according to the present invention.

Referring to FIGS. 11–13, the shuttle 16 is illustrated. The shuttle 16 defines a frontal surface 62 and an upper surface 64 within its front portion 68. A flange 66 extends upward along one side of the shuttle 16, being dimensioned and configured to abut the side flange 50 of the beam 14. The shuttle 16 is spring-biased forward. The rear portion 70 defines a spring channel 72, dimensioned and configured to contain and guide a compression spring 18. The shuttle 16 also includes an arm 74, preferably extending rearward and upward, and being dimensioned and configured to engage the rear arm 54 of the beam 14.

Figure 14:
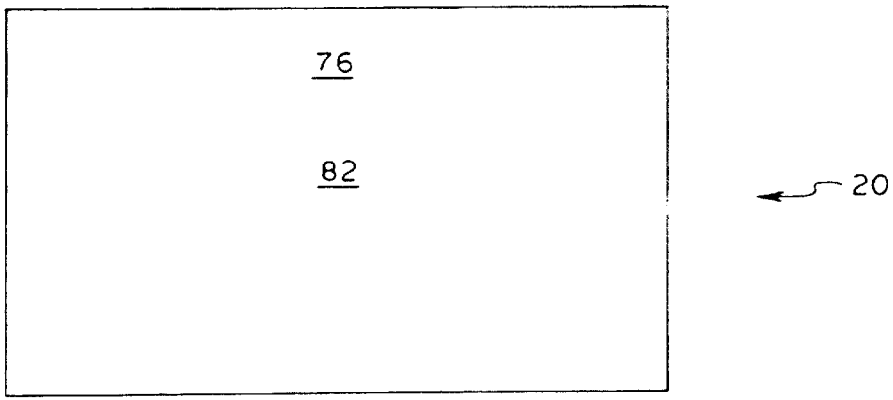
FIG. 14 is a rear view of the keeper for a latch assembly according to the present invention.
Figure 15:
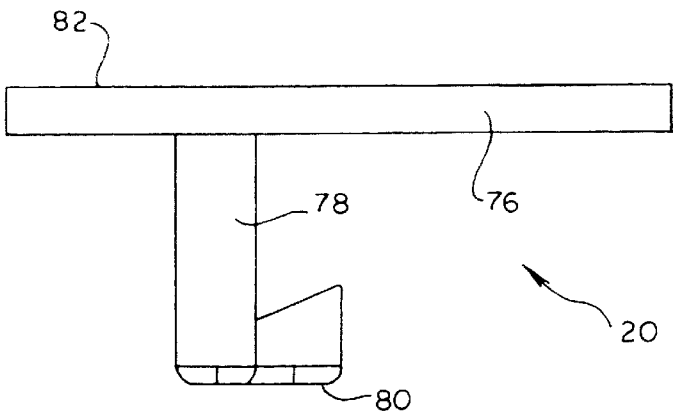
FIG. 15 is a side view of the keeper for a latch assembly according to the present invention.
Figure 16:
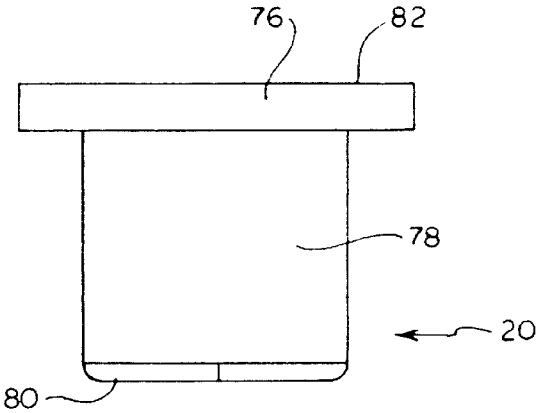
FIG. 16 is a bottom view of the keeper for a latch assembly according to the present invention.

Referring to FIGS. 14–16, the keeper 20 is illustrated. The keeper 20 includes a back panel 76 and a hook 78. The hook 78 is dimensioned and configured to pass through the front opening 32 of the housing 12, and to hook onto the beam's hook 48. The hook 78 includes front surface 80 for pushing inward on frontal surface 62 of shuttle 16. The rear of back panel 76 preferably includes an adhesive 82 for securing the keeper to one of the two components to be latched together using the latch.

The assembly of the latch 10 is illustrated in FIGS. 1–4. Spring 18 is inserted into the spring channel 72 of the shuttle 16, and the shuttle 16 is positioned adjacent to the beam 14 so that the bottom 49 of the beam's hook 48 corresponds to the upper surface 64 of the shuttle 16, and the rear arm 54 of the beam 14 corresponds to the rear portion 70 of the shuttle 16. The pre-assembled beam 14, shuttle 16, and spring 18 are then inserted through the front opening 32 of the housing 12. The spring is now sandwiched between the shuttle 16 and the rear 24 of housing 12. The beam's bosses 58 fit into the side openings 34, and are engaged by the inner snap legs 36. The shuttle's flange 66 abuts the beam's side flange 50, thereby securing the shuttle 16, beam 14, and spring 18 within the housing 12. In the unlatched, at rest position, the beam 14 is adjacent to the top 28 of the housing, with the front hook's bottom 49 resting on the upper surface 64 of the shuttle, and the side flange 50 abutting the shuttle's flange 66.

The latch 10 and keeper 20 will typically be mounted on opposing moving and nonmoving members, such as a door or drawer and the frame supporting the door or drawer (not shown, and well-known). Typically, the latch 10 will be installed on the nonmoving member, and the keeper 20 will be installed on the moving member, but this may be reversed without affecting the operation of the latch 10. The latch 10 will preferably be installed within a socket, with a preferred and suggested socket having the configuration of two intersecting rectangles, corresponding to the shape of the housing, to ensure proper alignment. Merely inserting the latch 10 into the socket, with the rear portion 24 entering the socket first, will cause the ridges 46 of the outer snap legs 44 to engage the edges of the socket, thereby securing the latch 10 within the socket. The keeper 20 is then inserted into the latch 10 for latching (as explained below), and the keeper's adhesive backing 82 is exposed. By bringing the moving member towards the nonmoving member, corresponding to the moving member's closed position, the keeper 20 is secured in the proper position on the opposing member to provide for latching and unlatching.

Figure 18:
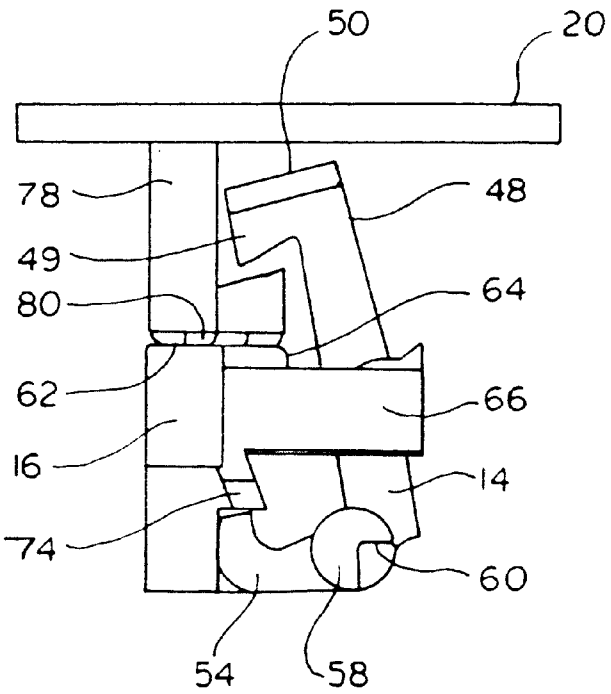
FIG. 18. is a side view of a latch assembly according to the present invention, showing the position of the parts after completion of the first step of the latching cycle.
Figure 17:
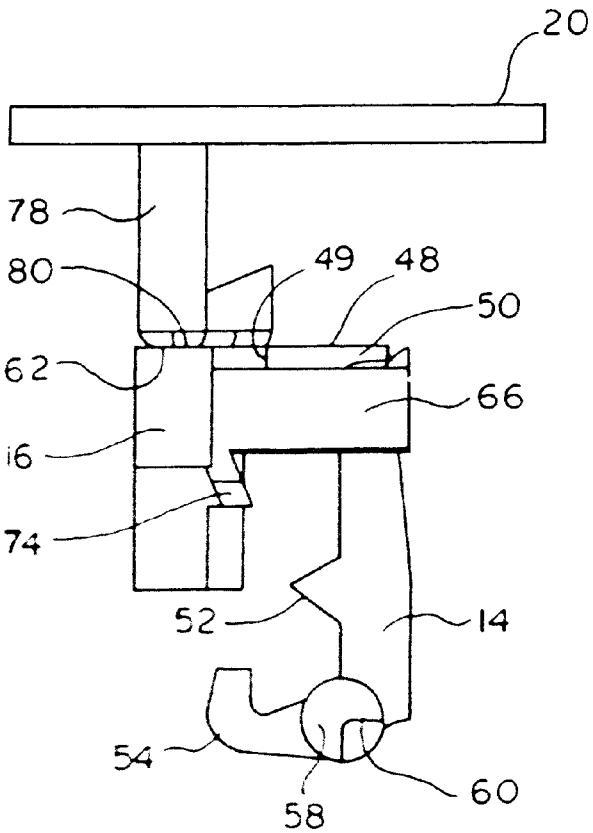
FIG. 17 is a side view of a latch assembly according to the present invention, showing the position of the parts at the beginning of the latching cycle.

The operation of the latch 10 is illustrated sequentially in FIGS. 17–21. The housing has been omitted from these figures for clarity. The initial unlatched position of the latch's components is illustrated in FIG. 17, wherein the moving and nonmoving members are being closed, and the keeper 20 has been brought through the housing's front opening 32 and into contact with the shuttle 16. The beam 14 is adjacent to the top 28 of the housing, with the front hook's bottom 49 resting on the upper surface 64 of the shuttle, and the side flange 50 abutting the shuttle's flange 66. FIG. 18 illustrates the front surface 80 of keeper 20 pushing inward on frontal surface 62 of shuttle 16. As the shuttle 16 is pushed rearward, the shuttle's arm 74 pushes against the beam's rear arm 54. The shuttle's upper surface 64 is simultaneously removed from under the lower surface 49 of the beam's hook 48. Because the beam's bosses 58 are constrained within the housing's side openings 34, the beam 14 rotates counterclockwise (in the illustration) so that the beam's hook 48 engages the keeper's hook 78. At this point, the user will release the pressure on the moving member, allowing the spring 18 to push the shuttle 16 slightly forward, into the position illustrated in FIG. 19. The shuttle 16 pushes the keeper 20 slightly outward, which will in turn pull the beam 14 into a horizontal position lower than its original position. The latch 10 is now securely latched.

Figure 20:
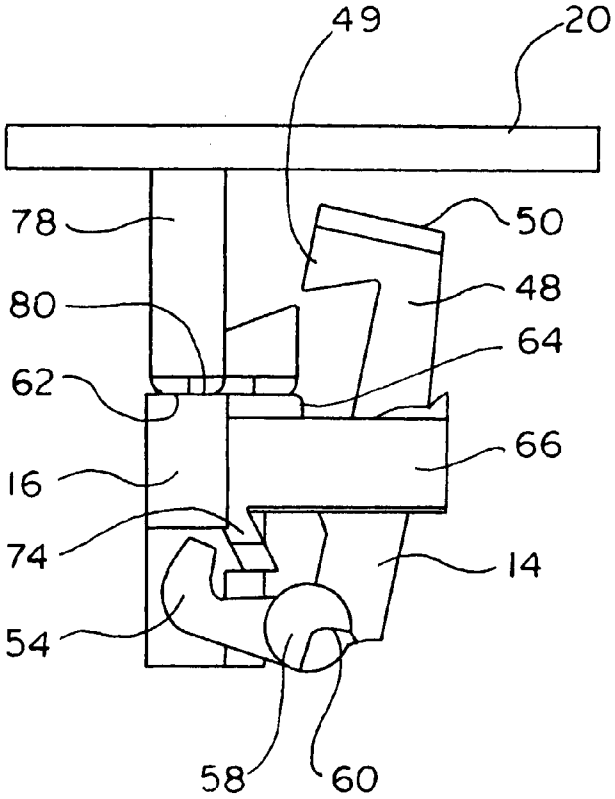
FIG. 20 is a side view of a latch assembly according to the present invention, showing the position of the parts after completion of the first step of the unlatching cycle.
Figure 19:
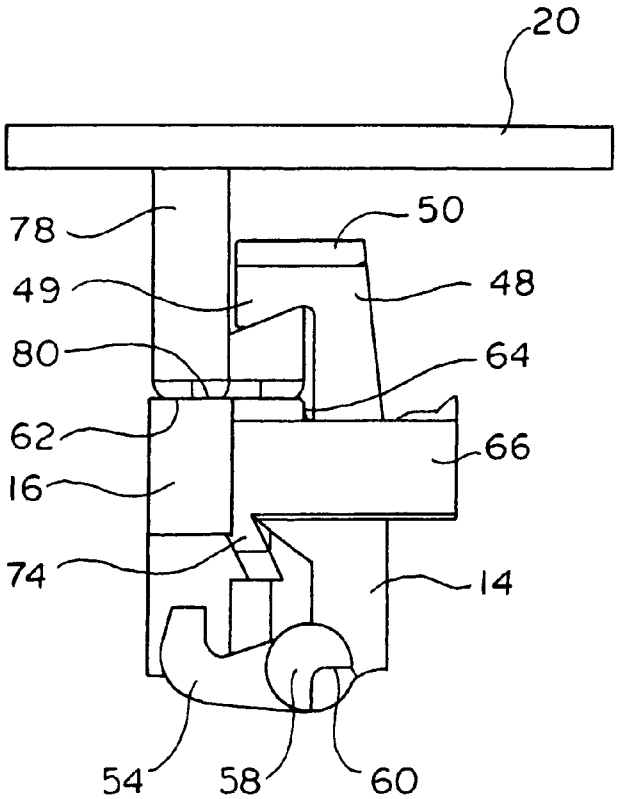
FIG. 19 is a side view of a latch assembly according to the present invention, showing the position of the parts at the completion of the latching cycle.
Figure 21:
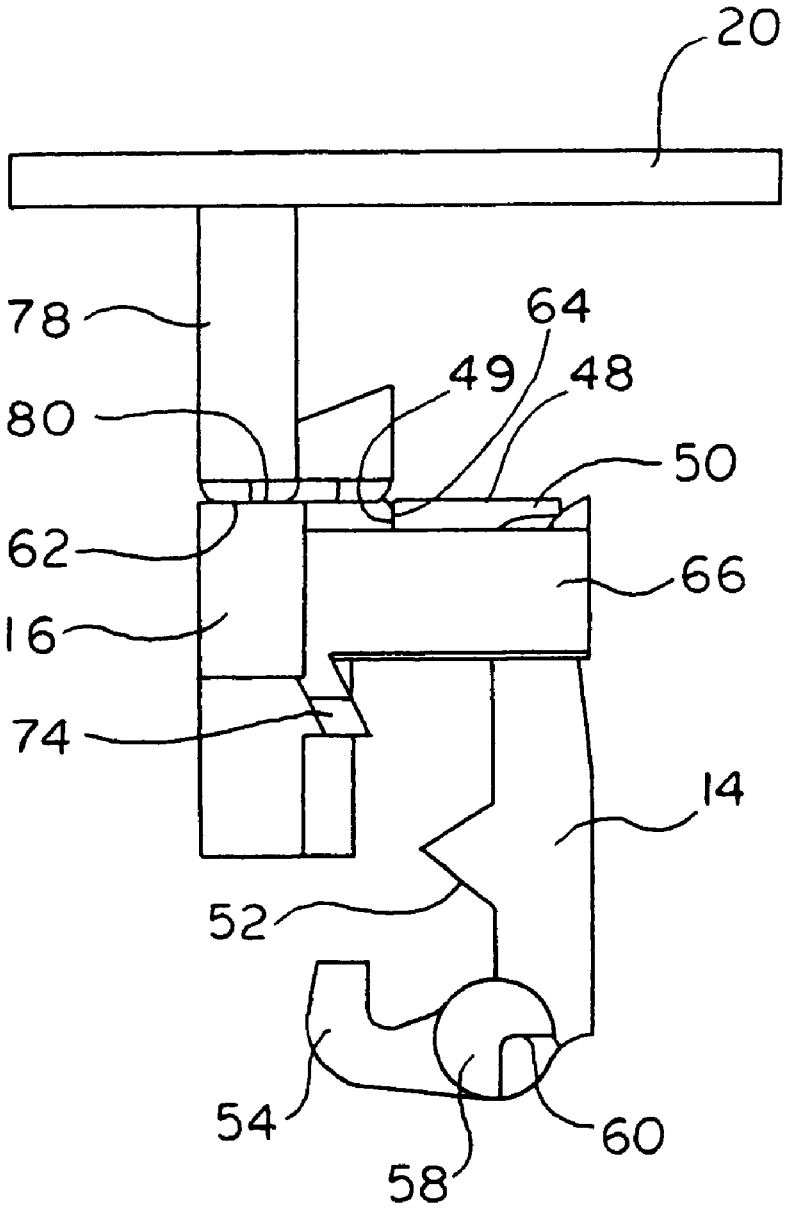
FIG. 21 is a side view of a latch assembly according to the present invention, showing the position of the parts after completion of the unlatching cycle.

The latch 10 is unlatched by pushing inward on the moving member, which again causes the front surface 80 of keeper 20 to push inward on frontal surface 62 of shuttle 16, illustrated in FIG. 20. The upper surface 64 of shuttle 16 pushes upward on the central projection 52 of the beam 14. The beam is constrained by the side openings 32 in housing 12. More specifically, the beam's bosses 58 are within the notches 38 of the side openings 32, and the notches 60 defined by the bosses 58 are abutting the convex curved edges 39 of the openings 32. The beam 14 therefore rotates upward, releasing the keeper 20. As the keeper 20 exits the housing 12, the shuttle 16 is pushed forward by spring 18, as illustrated in FIG. 21. The shuttle's flange 66 engages the beam's side flange 50, and the shuttle's upper surface 64 moves below the hook's lower surface 49, thereby moving the beam 14 back into its original upper horizontal position. The unlatching process is now complete, and the latch 10 is ready to repeat the cycle.

It is to be understood that the invention is not limited to the preferred embodiments described herein, but encompasses all embodiments within the scope of the following claims.

I claim:

1. A push-push latch for latching with a keeper, the keeper having a hooky said push-push latch comprising:

a housing defining a front opening and a pair of opposing side openings;

a beam having a front hook, said front hook being dimensioned and configured to mate with the hook of the keeper, said front hook having a side flange, a central downward projection, a rear portion, a rear arm within said rear portion, and a pair of bosses within said rear portion, said bosses being dimensioned and configured to fit within said side openings of said housing; and a shuttle at least partially within said housing, said shuttle having a frontal surface, an upper surface, at least one side, a flange extending upward from said at least one side, said flange being dimensioned and configured to abut said side flange of said beam, said shuttle further having an arm, said arm being dimensioned and configured to engage said rear arm of said beam, said shuttle being spring-biased forward.

2. The push-push latch according to claim 1, wherein each of said housing's side openings further comprise:

a front edge; and a snap leg extending rearward and inward from said front edge.

3. The push-push latch according to claim 1, further comprising a pair of snap legs extending outward and forward from said housing.

4. The push-push latch according to claim 3, wherein each of said snap legs includes a ridged end.

5. The push-push latch according to claim 1, wherein each of said housing's side openings further comprise a rear edge, and a notch within said rear edge.

6. The push-push latch according to claim 1, wherein each of said housing's side openings further comprise a rear edge, and a convex curved surface within said rear edge.

7. The push-push latch according to claim 6, wherein each of said beam's bosses defines a notch, said notch being dimensioned and configured to correspond to said convex curved surface within said side opening's rear edge.

8. The push-push latch according to claim 1, wherein said beam's hook includes a bottom flat surface.

9. The push-push latch according to claim 1, wherein said central downward projection is triangular in configuration.

10. The push-push latch according to claim 1, wherein said rear arm of said beam has a flat end.

11. The push-push latch according to claim 1, wherein said shuttle further comprises a spring channel.

* * * * *